United States Patent [19]

Boozer

[11] 4,409,717

[45] Oct. 18, 1983

[54] SWEDGING TOOL STRUCTURE AND USE

[75] Inventor: David W. Boozer, Douglasville, Ga.

[73] Assignee: Atlantic Building Systmes Inc., Atlanta, Ga.

[21] Appl. No.: 255,858

[22] Filed: Apr. 20, 1981

[51] Int. Cl.[3] ..... B21D 3/16; B21D 1/00; B23P 7/00; B21J 13/08

[52] U.S. Cl. ..... 29/402.19; 29/426.5; 29/458; 29/509; 29/283.5; 72/458; 81/3 R; 52/320

[58] Field of Search ..... 29/509, 243.5, 458, 29/426.5, 283.5, 402.05, 402.19; 72/479, 458; 81/3 R, 3.46; 52/520

[56] References Cited

U.S. PATENT DOCUMENTS

| | | | |
|---|---|---|---|
| 329,713 | 11/1885 | Caldwell | 72/458 |
| 471,637 | 3/1892 | Heberling | 72/458 X |
| 539,347 | 5/1895 | Caldwell | 72/458 |
| 733,394 | 7/1903 | Huffstickler | 72/458 |
| 922,702 | 5/1909 | Jopson | 81/3.46 UX |
| 1,773,362 | 8/1930 | Karl | 81/3.46 UX |
| 2,146,659 | 2/1939 | Stewert . | |
| 2,323,080 | 6/1943 | Anderson | 81/3.46 |
| 2,360,879 | 10/1944 | Kroier | 29/283.5 X |
| 2,547,391 | 4/1951 | Hauschild . | |
| 2,638,025 | 5/1953 | Nelson | 81/3 R |
| 2,938,413 | 5/1960 | Pauls . | |
| 3,166,961 | 1/1965 | Chaplin, Sr. | 72/458 X |
| 3,800,387 | 4/1974 | Hamilton | 29/243.58 |
| 3,902,350 | 9/1975 | McManus . | |
| 3,925,871 | 12/1975 | Beaumont . | |
| 4,034,595 | 7/1977 | Smith . | |

*Primary Examiner*—Charlie T. Moon

*Attorney, Agent, or Firm*—Cushman, Darby & Cushman

[57] ABSTRACT

A hand tool is provided for swedging female seams of standing seam roof panels. The tool includes a handle and a seam-engaging structure. The handle and seam-engaging structure can either be integral or in two pieces. The seam-engaging portion has first, second, and third substantially planar surfaces with the first and second surfaces making an acute angle with respect to each other, and the second and third surfaces making an acute with respect to each other. When placed in operative association with a female seam having an end edge and first and second bends, the seam can be "opened-up" by effecting bending at the second bend, while not disturbing the first bend or end edge. To open up an entirely closed seam, the hand tool is placed at an end-lap location and is impacted with a hammer to move from the endlap position to a more mid-seam location, and swedging is then effected.

15 Claims, 10 Drawing Figures

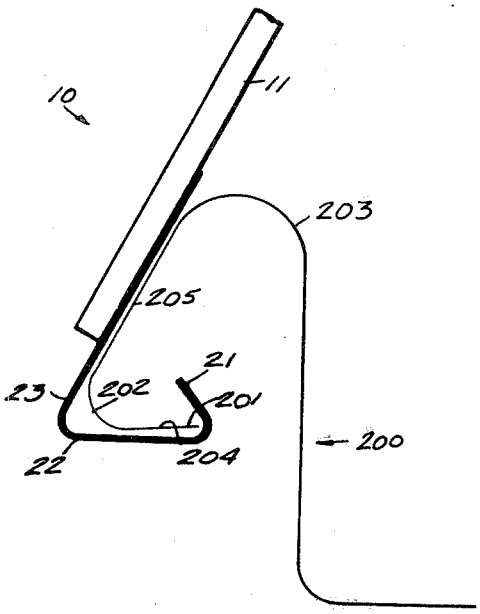
Fig. 6a
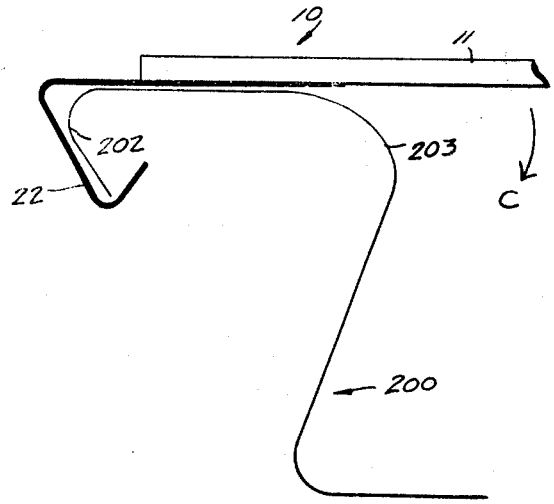
Fig. 6b
Fig. 6c
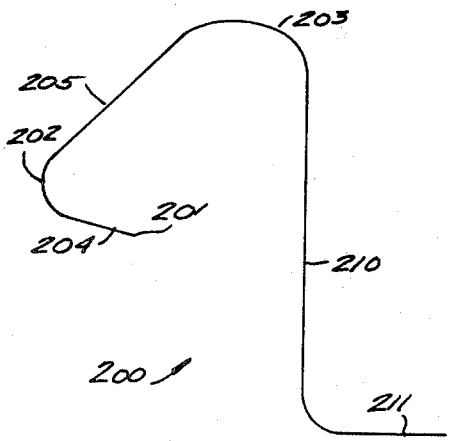
Fig. 6d
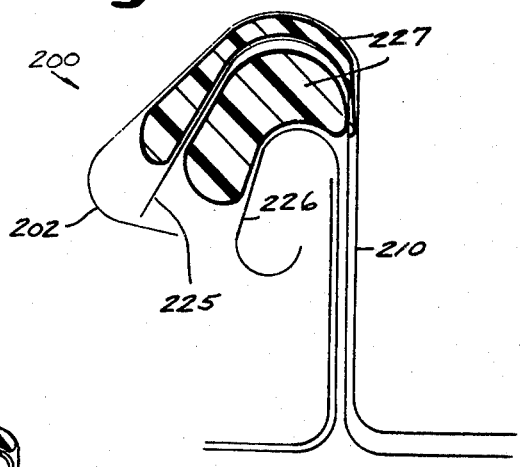
Fig. 6e
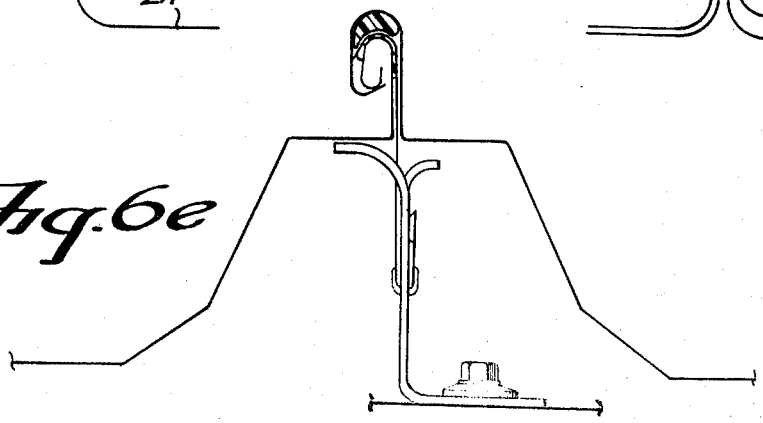

SWEDGING TOOL STRUCTURE AND USE

BACKGROUND AND SUMMARY OF THE INVENTION

In the construction of standing seam roof systems, it is necessary to be able to properly act upon the female seam in order to ensure proper positioning of all of the components together under all circumstances. In particular, it is necessary to ensure that the female seam is originally "opened-up" enough so that it will easily pass over seam components, which may include mastic thereon, and subsequently be deformed into place. Further, it is necessary to be able to repair minor damage due to bending, and the like, of the female seam. Further, it is sometimes necessary to effect unseaming during or after erection. For instance if panels are misaligned, further equipment such as roof curbs, vents, and the like are to be installed, or panels are damaged or leaking, unseaming is desired. This unseaming should be accomplished without damaging the panels.

According to the present invention, a hand tool, and a method of utilization thereof, are provided which are able to effect all of the advantageous results described above. That is, the hand tool according to the invention can be used to readily and efficiently open up female seams, can be used to repair some damage to the female seam, and can be utilized to unseam panels after installation to effect repair, etc. Additionally, the tool according to the invention is inexpensive and simple to construct, and is easy to utilize.

A hand tool according to the present invention consists of the following components: An elongated handle portion having first and second ends. A seam-engaging portion having first, second and third substantially planar surfaces; the first and second surfaces make an acute angle with respect to each other, and the second and third surfaces make an acute angle with respect to each other; the first surface terminates in a free end of the seam-engaging portion, the free end spaced from the third surface. Means for connecting the second end of the handle portion to the seam-engaging portion third surface so that the handle extends substantially transverse to a plane containing the seam-engaging portion first surface free end. And, the handle first end has a width substantially less than the width of the first and second surfaces of the seam-engaging portion. The handle and seam-engaging portions are preferably of metal and may be integral or separate and distinct members. Where they are separate and distinct members welds may hold them together.

The hand tool is designed for acting on a female seam having an end edge, first and second bends substantially parallel to the end edge, and first and second straight portions between the end edge and the first bend, and the first and second bends, respectively. The tool first surface means is for engaging the end edge of the female seam, while the tool second surface means extends substantially parallel to the female seam first straight portion. The tool third surface means extends substantially parallel to, and is provided for supporting, the female seam second straight portion so that as the handle portion is rotated with the first surface means engaging the end edge of the female seam, the female seam is bent about the second bend while the first bend and the end edge of the female seam remain in original condition.

A method is provided according to the present invention for acting upon a female seam of a standing seam roof panel. The method comprises the following steps: (a) Placing a hand tool into operative association with the female seam end edge and first and second straight portions. Where the female seam is closed this step is accomplished by placing the hand tool at an endlap location of the closed female seam, and impacting (as with a hammer) the hand tool to cause it to move from the endlap location to a more mid-seam location. (b) Maintaining the end edge and first bend of the female seam in their original condition while rotating the hand tool to effect bending of the female seam about the second bend. And (c) removing the hand tool from operative association with the female seam once a desired degree of bend of the female seam second bend has been achieved. Where a seam is being opened-up, steps (a) and (b) are repeated until the desired amount of opening up of the width of the seam has been accomplished.

It is the primary object of the present invention to provide a simple and effective hand tool, and method of utilization thereof, for acting upon female seams of standing seam roof panels. This and other objects of the invention will become clear from an inspection of the detailed description of the invention, and from the appended claims.

BRIEF DESCRIPTION OF THE DRAWINGS

FIGS. 6*a* through 6*e* illustrate a method of acting upon a female seam according to the present invention.

DETAILED DESCRIPTION OF THE DRAWINGS

Figure 1:
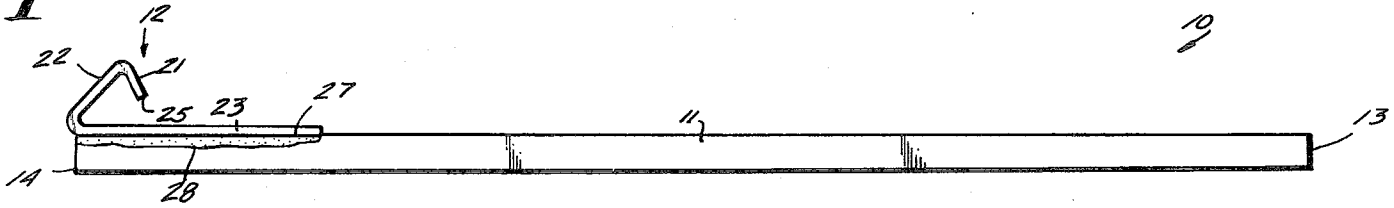
FIG. 1 is a side view of a first embodiment of an exemplary hand tool according to the present invention.
Figure 2:
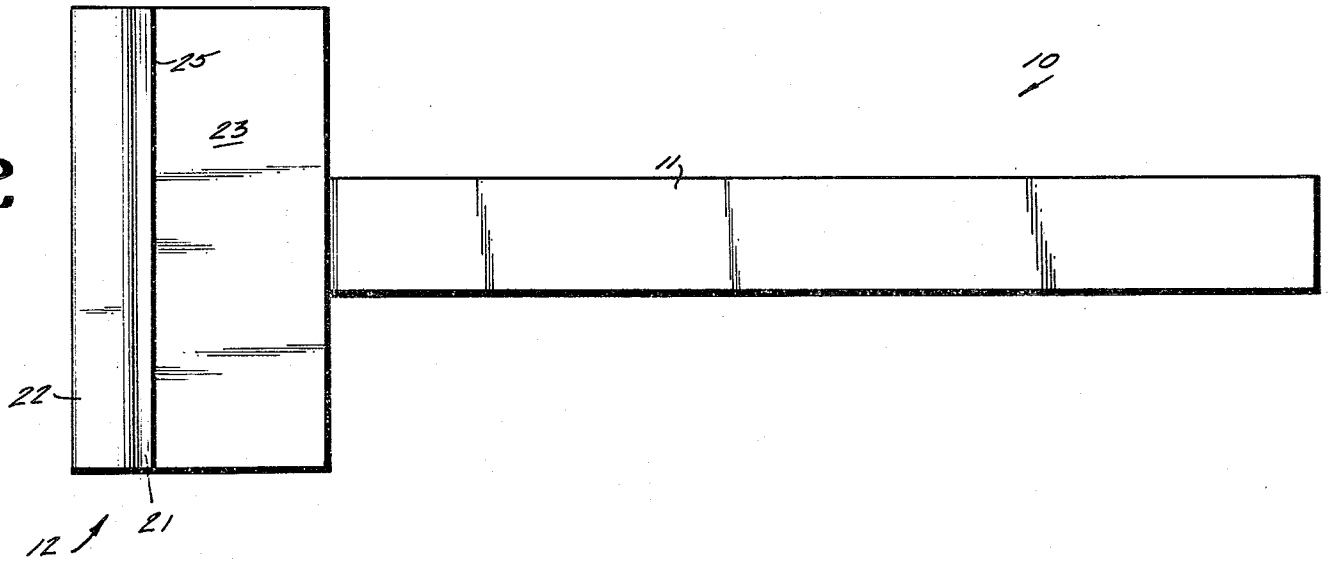
FIG. 2 is a top plan view of the tool of FIG. 1.

A first embodiment of an exemplary hand tool according to the present invention is illustrated generally at 10 in FIGS. 1 and 2. This is basically a two-piece structure, including a handle portion 11 and a seam-engaging portion 12. The handle portion 11 is elongated and has first and second ends 13, 14, respectively. The seam-engaging (or work-engaging, in the general case) portion is made from a sheet of relatively stiff metal (e.g., steel having a stiffness greater than that of the seams or work with which it will be utilized).

The seam-engaging portion 12 includes first, second, and third substantially planar surfaces, indicated by reference numerals 21, 22, and 23, respectively. The first and second surfaces 21, 22 make an acute angle B with respect to each other, this angle—in the embodiment illustrated in the drawings—being about 50°. The second and third surfaces 22, 23 make an acute angle A with respect to each other, this angle A—in the embodiment illustrated in the drawings—being about 65°. As seen most clearly in FIG. 1, a free end 25 of the first surface 21 is spaced from the third surface 23.

The seam-engaging portion 12 is substantially wider than the handle portion 11, as seen most clearly in FIG. 2. Means are provided for operatively connecting the portions 11, 12 together, and in particular so that the handle 11 is connected at the second end 14 thereof to a bottom portion 27 of the plate forming the third surface 23. This is preferably provided by welds 28 between side edges of the handle 11 and the bottom portion 27 (see FIG. 1). Of course, other suitable attaching means may also be provided depending upon materials, use requirements, etc. Further, the handle 11 is located substantially at the mid-area of the seam-engaging portion 12, and is elongated in a dimension perpendicular to the dimension of elongation of the free edge 25 of the first surface 21.

In constructing the hand tool 10 illustrated in the drawings, a steel sheet is utilized to form the portion 12, a 130° bend being made to form the angle B and surfaces 21, 22, and a 115° bend being made to form the angle A and the surfaces 22, 23. In the embodiment illustrated in the drawings, a typical width of the surfaces 21 through 23 would be four inches, a typical width of the handle 11 would be one inch, a typical thickness of the handle 11 would be one-quarter inch, a typical length of the handle 11 would be eight inches, a typical length of the first surface 21 would be 11/32 of an inch, a typical length of the second surface 22 would be 19/32 of an inch, and a typical length of the third surface 23 would be $1\frac{5}{8}$ inch.

Figure 3:
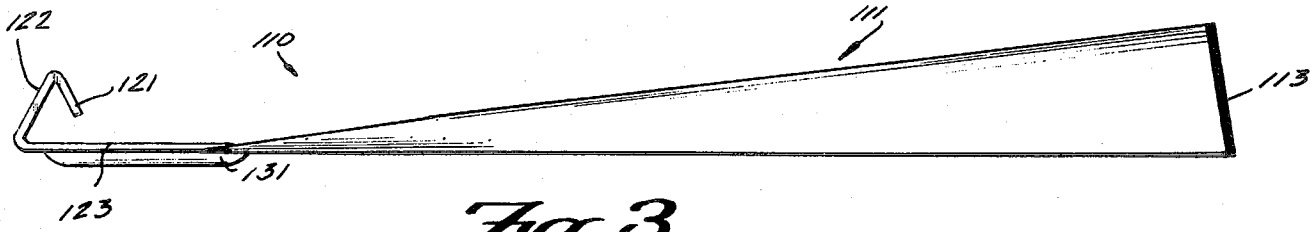
FIG. 3 is a side view of an exemplary second embodiment of the tool according to the present invention.
Figure 4:
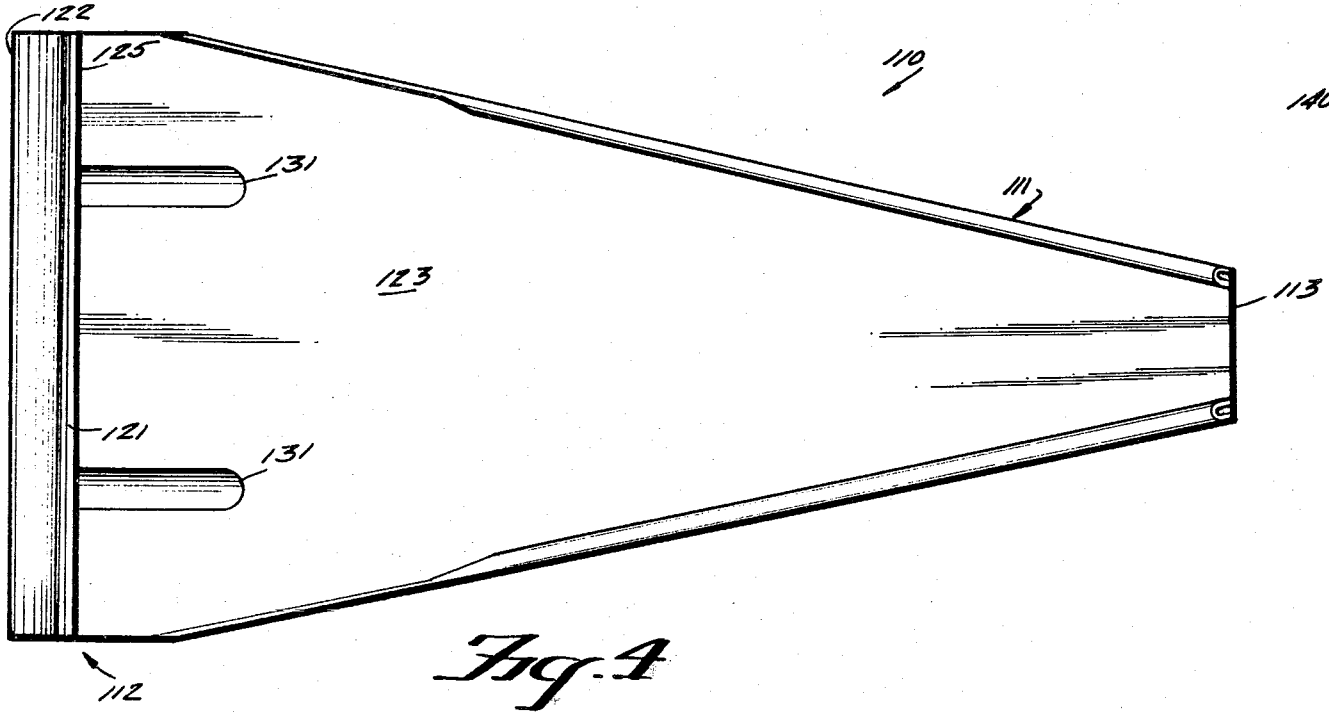
FIG. 4 is a top plan view of the tool of FIG. 3.

A second embodiment according to the present invention is illustrated in FIGS. 3 and 4. In this embodiment, the structures corresponding to those in the FIGS. 1 and 2 embodiment are indicated by a like reference numeral, only preceded with the numeral "1". As can be seen by an inspection of FIGS. 3 and 4, this embodiment differs primarily from the embodiment illustrated in FIGS. 1 and 2 in that the tool 110 is of integral contruction. That is, the same sheet of metal is used to form the handle portion 111 and the seam-engaging portion 112. Stiffening ribs 131 are introduced into the third surface means 123 in order to minimize the possibilities of bending of the operative components of the seam-engaging portion 112.

Figure 5:
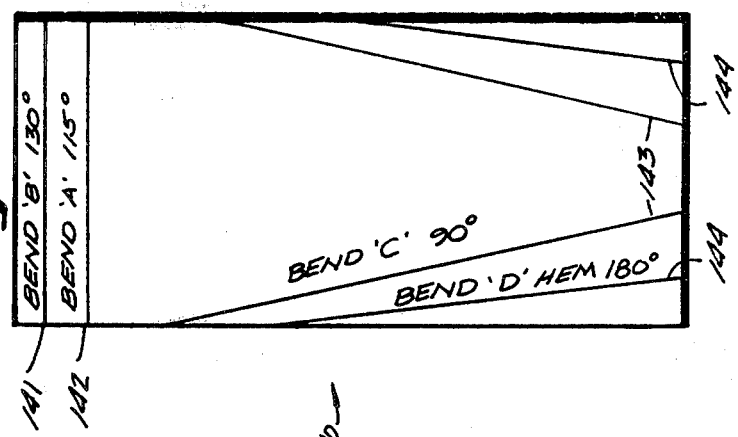
FIG. 5 is a top plan view of a blank sheet which may be acted upon to form the tool of FIGS. 3 and 4.

FIG. 5 illustrates a blank sheet 140 which may be utilized to construct the device 110. Bends are made at the appropriate points 141, 142 to form the angles B and A, respectively, while other bends are made along lines 143 and 144 in order to effect formation of the handle 111.

The utilization of the tool 10 for practicing a method of acting upon a female seam 200 is illustrated in FIGS. 6*a* through 6*d*. As will be seen (see FIG. 6*c* in particular), a typical female seam 200 includes an end edge 201; first and second bends 202, 203, the bends 202, 203 being substantially parallel to the end edge 201; and first and second straight portions 204, 205, between the end edge 201 and the first bend 202, and the first and second bends 202, 203, respectively. On the opposite side of the second bend 203 as the second straight portion 205, other portions 210, 211, etc., of the seam are provided.

As a first step (a) in acting on a female seam 200 in accordance with the present invention, the hand tool is placed into operative association with the female seam end edge 201, and first and second straight portions 204, 205, respectively. This is indicated in FIG. 6*a* wherein the end edge 201 engages (or substantially engages) the first surface means 21 of tool 10, the first surface 204 of the female seam is substantially parallel to the second surface 22 of the tool 10, and the second surface 205 of the seam 200 is substantially parallel to, and engaged by, the third surface means 23 of the tool 10. In this way, the integrity of the end edge 201 and first bend 202 of the female seam 200 is maintained during subsequent swedging action.

The second step (b) in the practice of the method according to the present invention is maintaining the end edge 201 and first bend 202 of the female seam 200 in their original condition while rotating the hand tool 10 in direction C (see FIG. 6*b*) to effect bending of the female seam 200 about the second bend 203. This is accomplished by grasping the handle 11 and effecting rotation in direction C, as illustrated in FIG. 6*b*. Once the desired extent of bending of the bend 203 is effected, the hand tool 10 is then (c) removed from operative association with the seam 200. FIG. 6*c* illustrates a female seam that has been "opened-up" in accordance with the present invention. That is, the distance between the end edge 201 and the seam portion 210 of the seam 200 is greater after swedging than before (compare FIGS. 6*a* and 6*c*).

As illustrated in FIG. 6*d*, after swedging the female seam 200 may be placed over other seam components to effect ultimate formation of the standing seam of the roof panel. Other seam components are illustrated generally at 225 and 226 in FIG. 6*d*, mastic 227 also being provided where appropriate. The assembled standing seam at an endlap, just prior to crimping, is illustrated in FIG. 6*d*, while a mid-portion of the standing seam after crimping in a conventional manner is illustrated in FIG. 6*e*. (See copending application Ser. No. 56,943, filed July 12, 1979, now U.S. Pat. No. 4,361,998, issued Dec. 7, 1982, and references of record therein).

Where the tool 10 is utilized for opening up a closed seam (e.g. that of FIG. 6*e*), step (a) is practiced by placing the hand tool 10 at an endlap (e.g., FIG. 6*d*) location of the closed female seam. The free edge of the seam-engaging portion 12 not abutting the seam is then impacted, as with a hammer, to cause it to move from the endlap location to a more mid-seam location. Then, the swedging operation (see FIG. 6*b*) is effected. After swedging at that point, the tool 10 is again impacted to drive it further along the seam, and swedging is practiced once again, until the entire seam is opened. This allows for ready repositioning of misaligned panels, installation of new equipment such roof curbs or vents, and replacement or repair of panels that have been damaged, or where there is leakage.

Of course, the tool and method according to the present invention are utilizable with a wide variety of other specific standing-seam constructions than the specific seam 200 illustrated in the drawings, and also is utilizable for removing clamping caps or other components of diverse roof panel construcitons.

It will thus be seen that according to the present invention a simple and effective swedging tool, and manner of utilization thereof, have been provided, allowing the practice of many worthwhile procedures during standing-seam roofing systems construction or repair.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A hand tool for acting upon a female seam of a standing seam roof panel, the female seam having an end edge, first and second bends substantially parallel to the end edge, and first and second straight portions between the end edge and the first bend, and the first and second bends, respectively; said tool comprising:

a handle portion;

first, second, and third surface means of a seam-engaging portion;

means for attaching said handle portion to said third surface means;

said first surface means for engaging the end edge of a female seam, and being disposed remote from said handle portion;

said second surface means extending substantially parallel to a female seam first straight portion, and being disposed between said first and third surface means;

said third surface means extending substantially parallel to and for supporting a female seam second straight portion, so that as said handle portion is rotated with said first surface means engaging the end edge of a female seam, the female seam is bent about the second bend while the first bend and the end edge of the female seam remain in original condition; and said handle and seam-engaging portions being of stiffer material than that of portions of said female seam of said standing seam roof panel to be bent thereby.

2. A tool as recited in claim 1 wherein said handle and seam-engaging portions are integral, formed from a common metal sheet.

3. A tool as recited in claim 2 further comprising stiffening ribs provided in the third surface means.

4. A tool as recited in claim 1 wherein said handle portion and said seam-engaging portion are separate and distinct pieces, and wherein said means for attaching said portions together comprises separate and distinct fastening means.

5. A tool as recited in claim 4 wherein said handle and seam-engaging portions are made of metal, and wherein said distinct fastening means comprises weld means between said handle portion and said third surface means.

6. A tool as recited in claims 4 or 5 wherein said seam-engaging portion is much wider than the width of said handle, and wherein said handle portion is operatively connected to a central portion of said third surface means along the width thereof.

7. A tool as recited in claim 1 wherein said first and second surface means make an angle of about 50°, and wherein said second and third surface means make an angle of about 65°.

8. A tool as recited in claim 1 wherein said seam-engaging portion is constructed from a sheet of metal, various bends being introduced into the metal sheet to construct said first and second, and second and third, surface means.

9. A hand tool, for acting upon a work component of a roof panel construction, said tool consisting of:

an elongated handle portion having first and second ends;

a work-engaging portion formed of stiffer material than that of a work component to be acted on thereby, said work-engaging portion having first, second, and third substantially planar surfaces; said first and second surfaces making an acute angle with respect to each other, and said second and third surfaces making an acute angle with respect to each other, said acute angles being on the same side of said work-engaging portion; said first surface terminating in a free end of said work-engaging portion, said free end spaced from said third surface;

means for connecting said second end of said handle portion to said work-engaging portion third surface so that said handle extends substantially transverse to a plane containing said work-engaging portion first surface free end; and said handle first end having a width substantially less than the width of said first and second surfaces of said work-engaging portion.

10. A tool as recited in claim 9 wherein said angle between said first and second surfaces is about 50°, and said angle between said second and third surfaces is about 65°.

11. A tool as recited in claim 10 wherein said handle and work-engaging portions are of metal, and are separate and distinct members, and wherein said means for connecting said portions together comprises weld means between the bottom of a plate defining said third surface, and side edges of said handle portion.

12. A method of acting upon a female seam of a standing seam roof panel, the female seam having an end edge, first and second bends substantially parallel to the end edge, and first and second straight portions between the end edge and the first bend, and the first and second bends, respectively; said method comprising the steps of:

(a) placing a hand tool in operative association with the female seam end edge and first and second straight portions;

(b) maintaining the end edge and first bend of the female seam in their original condition while rotating the hand tool to effect bending of the female seam about the second bend, the hand tool having operative portions stiffer than the second bend of the female seam; and (c) removing the hand tool from operative association with the female seam once the desired degree of bend of the female seam second bend has been achieved.

13. A method as recited in claim 12 comprising the further step of placing the female seam, at the second bend, over other standing seam roofing panel components, and assembling the components together to provide a standing seam roof.

14. A method as recited in claim 12 wherein step (b) is accomplished by: by constructing the hand tool so that it has a first surface means for engaging the end edge of the female seam, second surface means extending substantially parallel to the female seam first straight portion, and third surface means extending substantially parallel to and for supporting the female seam second straight portion; and by engaging the female seam end edge with the first surface means, and engaging the female seam first straight portion with the second surface means, and by engaging at least a portion of the female seam second straight portion with the third surface means.

15. A method as recited in claim 12 wherein the female seam is closed, and wherein step (a) is practiced by placing the hand tool at an endlap location of the closed female seam, and impacting the hand tool to cause it to move from the endlap location to a more mid-seam location.

* * * * *